US006002129A

United States Patent [19]

Ito et al.

[11] Patent Number: 6,002,129

[45] Date of Patent: Dec. 14, 1999

[54] INDUCTIVELY COUPLED PLASMA MASS SPECTROMETRIC AND SPECTROCHEMICAL ANALYZER

[75] Inventors: Tetsumasa Ito; Yoshitomo Nakagawa; Osamu Matsuzawa, all of Chiba, Japan

[73] Assignee: Seiko Instruments Inc.

[21] Appl. No.: 09/078,470

[22] Filed: May 14, 1998

[51] Int. Cl.[6] ..... H01J 49/36

[52] U.S. Cl. ..... 250/288; 250/281

[58] Field of Search ..... 250/288, 281

[56] References Cited

U.S. PATENT DOCUMENTS 5,477,048 12/1995 Nakagawa et al. ..... 250/288

*Primary Examiner*—Kiet T. Nguyen
*Attorney, Agent, or Firm*—Adams & Wilks

[57] ABSTRACT

A sample introducing apparatus for an inductively coupled plasma mass spectrometric and spectrochemical analyzer is provided to have a branch pipe at a sample pipe of a plasma torch for introducing an oxygen gas controllable in flow rate. The sample, after mixed with a sufficient amount of oxygen, is burnt by a plasma to oxidize and vaporize carbon.

2 Claims, 2 Drawing Sheets

INDUCTIVELY COUPLED PLASMA MASS SPECTROMETRIC AND SPECTROCHEMICAL ANALYZER

BACKGROUND OF THE INVENTION

The present invention relates to an inductively coupled plasma mass spectrometric and spectrochemical analyzer, and more particularly to an organic solvent sample introducing apparatus.

A conventional inductively coupled plasma mass spectrometric analyzer is structured, as shown in FIG. 2, by a plasma-generating torch 4 and a chamber 9 connected to the torch 4 for serving as a sample introducing section. The chamber 9 is provided with a support member 12 at one end through an O-ring 11. The support member 12 is fitted with a nebulizer 13 to atomize a sample 18. The sample 18 contained in a sample vessel 17 is supplied through a sample supply tube 16 to the nebulizer 13. Here, a nebulizer gas reserved in a nebulizer gas supply section 15 is supplied to the nebulizer 13 through a nebulizer gas supply tube 14. The sample 18 is atomized by this nebulizer 13 and then introduced to the torch 4 by way of the chamber 9. The chamber 9 has a drain port 10 at its lowermost portion to discharge a waste solution.

The torch 4 is structured by coaxial triple pipes so that the sample 18 introduced from the chamber 9 passes through an innermost pipe 5 of the three pipes into a plasma 2. The sample 18 is ionized in the plasma 2 and analyzed by a mass spectrometer (not shown) after passing through an aperture formed in a sampling cone 1 composing an analyzing section of the inducively coupled plasma analyzer. The innermost pipe 5 of the torch 4 has thereover an intermediate pipe 8*a* through which an auxiliary gas is passed from an auxiliary gas supply port 8. The intermediate pipe 8*a* has thereover an outermost pipe 24 through which a plasma gas (a gas that itself is later turned into a plasma by an application of an radio-frequency electric power) is supplied to a tip of the torch 4.

The chamber 9 has an exit pipe 23 to introduce the finely atomized sample into the innermost pipe 5. The innermost pipe 5 and the exit pipe 23 are connected at their ends in a fluid connection by means of a clamp 6.

Where the sample 18 to be introduced is an organic solvent, the carbon C contained in the introduced sample tends to adhere to the tip of the torch 4 or the aperture of the sampling cone 1, causing plugging or decrease in analytical sensitivity. To avoid this, a gas introducing port 21 is provided in the support member 12 to supply therethrough an oxygen gas into the chamber 9 where the oxygen gas is mixed with the sample 18 and introduced into the plasma 2, thereby solving the problem. That is, the carbon C contained in the sample 18 mixed with the oxygen gas is burnt in the plasma 2 and turned into carbon dioxide $CO_2$ or carbon monoxide CO. Since such carbon dioxide $CO_2$ or carbon monoxide CO passes through the aperture of the sampling cone 1 or dissipated to the atmosphere, there is no carbon adhesion to the tip of the torch 4 or the aperture of the sampling cone 1.

In the above-stated prior art, however, the oxygen gas introduced through the gas introducing port 21 in the support member 12 and the organic solvent atomized through the nebulizer 13 fixed on the support member 12 are mixed within the chamber 9. At this time, if static electricity, back fire, radio frequency wave or the like causes the organic solvent mixed with the oxygen gas present within the chamber 9 to be ignited, there is a fear of burst of the chamber 9. To avoid this, the introducing amount of the oxygen gas must be kept low. However, where the amount of the introduced oxygen gas is reduced lower than the amount required to sufficiently burn the carbon C of the sample, the carbon C is not sufficiently turned into carbon dioxide $CO_2$ or carbon monoxide CO, thus resulting in plugging at the tip of the torch 4 or the aperture of the sampling cone 1 and hence decrease in analytical sensitivity.

It is an object of the present invention to provide an inductively coupled plasma mass spectrometric analyzer which is capable of solving the above-stated problem, preventing plugging and enabling high sensitivity measurement without a fear of bursting the chamber 9 even if the oxygen gas flows in a sufficient amount for suppressing the plugging at the tip of the torch 4 or the sampling cone 1 as well as the decrease in sensitivity due to the carbon C contained in a sample.

SUMMARY OF THE INVENTION

In order to achieve the above object, an organic solvent sample introducing apparatus for an inductively coupled plasma mass spectrometric analyzer adopted in the present invention has a branch pipe at an innermost pipe of a torch so that an oxygen gas controllable in flow rate is introduced through the branch pipe.

The organic solvent sample introducing apparatus for an inductively coupled plasma mass spectrometric analyzer of the present invention has the branch pipe at the innermost pipe of the torch so that an oxygen gas is introduced through the branch pipe. The flow rate of a nebulizer gas ejected from a nebulizer is sufficiently high as compared with that of the oxygen gas supplied through the branch pipe, and further the nebulizer gas flows from a airtight chamber toward the tip of the torch as an exit. Accordingly, the oxygen gas flows toward the torch from the branch pipe, without flowing into the chamber. Therefore, the oxygen concentration within the chamber is kept extremely low.

Since the oxygen concentration within the chamber can be decreased, if a back fire should occur toward the chamber, no burning occurs within the chamber. Thus, there is no fear of burst of the chamber. It is therefore possible to flow an oxygen gas in a sufficient amount required to suppress the plugging at the torch tip or the sampling cone as well as the decrease in sensitivity due to carbon C. Thus, plugging is prevented and high sensitive measurement becomes possible.

DETAILED DESCRIPTION OF THE INVENTION

Figure 1:
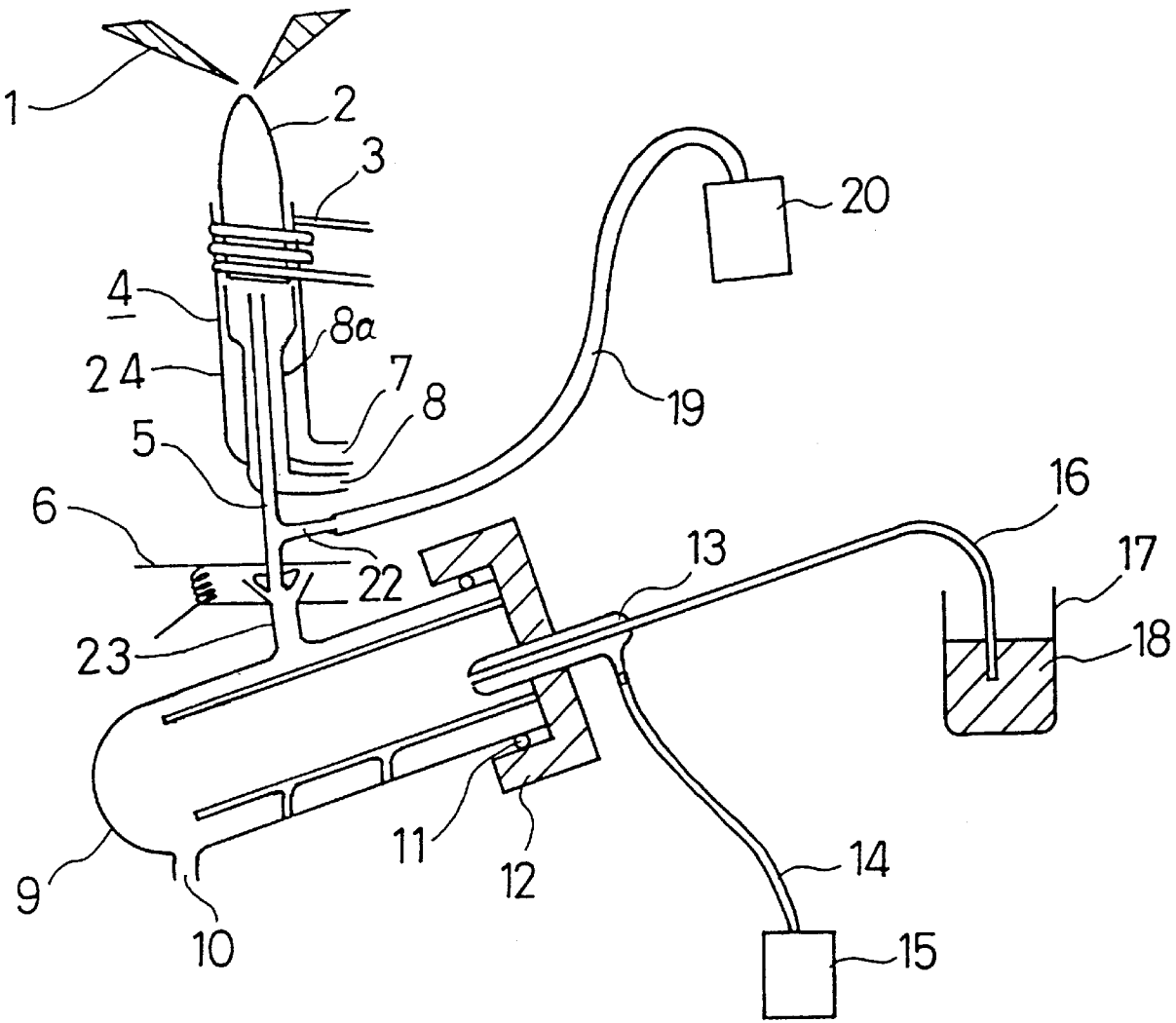
FIG. 1 is a schematic sectional view of a sample introducing apparatus for an inductively coupled plasma mass spectrometric analyzer according to an embodiment of the present invention.
Figure 2:
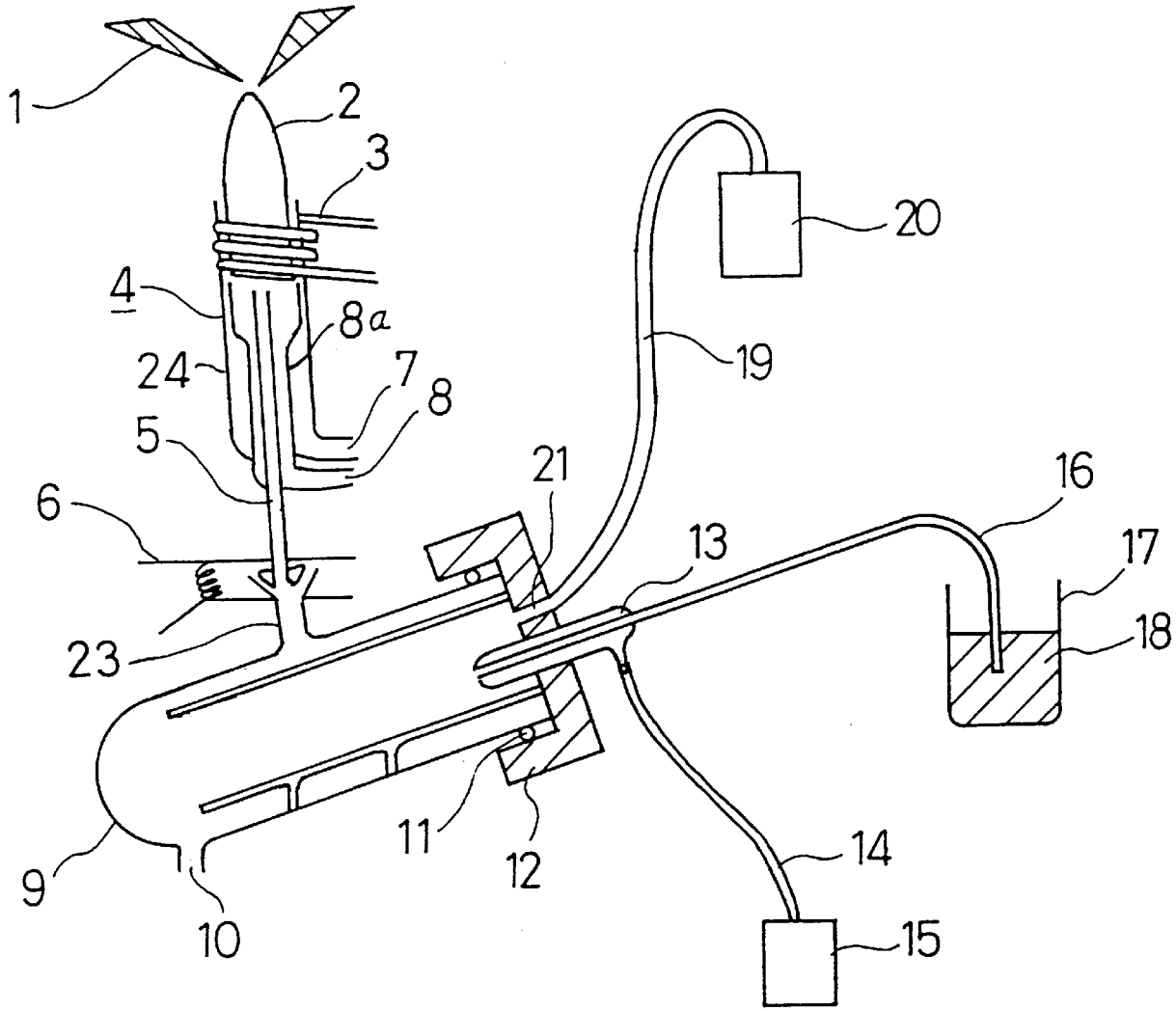
FIG. 2 PRIOR ART
FIG. 2 is a schematic sectional view of an example of a conventional sample introducing apparatus for an inductively coupled plasma mass spectrometric analyzer.

The present invention will now be explained in detail with reference to FIG. 1. Note that, in FIG. 1, descriptions of parts or elements depicted in FIG. 2 and having a similar or same function might be omitted.

An inductively coupled plasma mass spectrometric and spectrochemical analyzer includes a chamber 9. The chamber 9 is provided with a torch 4 at an above face to generate an inductively coupled plasma 2. The chamber 9 is also provided with a cylindrically-formed support member 12 at its end. The support member 12 is fitted with a nebulizer 13. The torch 4 and the chamber 9 are connected by a clamp 6 so that their joint surfaces are prevented from leakage. An O-ring 11 is interposed between the chamber 9 and the support member 12 to prevent a gas within the chamber 9 from leaking outside, thus keeping airtightness. Incidentally, an unillustrated tip of a drain port 10 is formed in a siphon so that the inside of the chamber 9 is kept airtight by a liquid.

The nebulizer 13 is connected with a nebulizer gas supply tube 14 and a sample supply tube 16. An end of the sample supply tube 16 is submerged in a sample 18 contained in a sample vessel 17.

Now, a gas supplied from a nebulizer gas supply 15 passes through the nebulizer gas supply tube 14 and is ejected at a tip of the nebulizer 13. This causes the pressure within the nebulizer 13 to decrease so that the sample 18 in the sample vessel 17 is drawn through the sample supply tube 16 to the nebulizer 13 by the resulting negative pressure. The sample 18 is then ejected into the inside of the chamber 9, thus providing a sample in a mist form.

This sample 18 in the fine mist form is supplied from the chamber 9 through an exit pipe 23 to the torch 4. However, the rest greater particulate portion of the sample is discharged through the drain port 10 of the chamber 9. Thus, the nebulized sample is separated in the chamber 9.

Meanwhile, the torch 4 is structured by a triple-walled quartz tube. A gas (e.g. argon gas) is supplied from a plasma gas supply port 7 through an outermost pipe 24 to a tip of the torch 4 where a radio-frequency electric power (e.g. a frequency of 27.12 MHz, an electric power of 1.6 kW) is supplied to an induction coil 3, thereby generating a plasma 2. Meanwhile, an auxiliary gas is also supplied from an auxiliary gas supply port 8 through an intermediate pipe 8*a* to the tip of the torch 4.

The sample 18 that has reached the torch 4 via the chamber 9 passes the innermost pipe 5 of the triple pipes of the torch 4. Now, an oxygen gas supplied from an oxygen gas supply section 20 passes through an oxygen gas supply tube 19 and is fed from a branch pipe 22 provided at the innermost pipe 5 of the torch 4 to the innermost pipe 5 where the oxygen gas is mixed with the sample 18.

Here, the nebulizer gas being ejected from the nebulizer 13 is sufficiently high in flow rate as compared with the oxygen gas being supplied through the branch pipe 22. Further, the nebulizer gas is flowing from the airtight chamber 9 toward the tip of the torch 4 as an exit. Accordingly, the oxygen gas is drawn toward the torch 4 from the branch pipe 22, without flowing into the chamber 9. Accordingly, the oxygen concentration within the chamber 9 is extremely low. Since the oxygen concentration can be decreased within the chamber 9, if a back fire should occur toward the chamber 9, there is no possibility of occurring burning leading to bursting.

The sample 18 mixed with a sufficient amount of the oxygen gas flows through the innermost pipe 5 to reach a top of the torch 4 where it is burnt by the plasma 2. The carbon C content of the sample is turned into carbon dioxide $CO_2$ or monoxide CO and passes through an aperture of a sampling cone 1 or dissipated into the atmosphere. The rest part of the sample is ionized by the plasma 2. The sample 18 being ionized passes through the aperture of the sampling cone 1 and analyzed by the mass spectrometer.

That is, the present invention provides an inductively coupled plasma mass spectrometric analyzer, comprising: a nebulizer for atomizing a liquid sample; a chamber for separating an atomized sample; pipes separated by fluid therein for introducing and transporting therethrough the separated sample and a plasma gas (in the embodiment, the sample and the plasma gas flow through the innermost pipe 5 and the outermost pipe 24, respectively), respectively, a torch having an induction coil arranged around a tip of the pipes so that a plasma is formed by a radio-frequency electric power supplied to the induction coil; a branch pipe connected to the pipe of the torch to which the separated sample is introduced and transported, and being for introducing therethrough an oxygen gas controllable in flow rate to the pipe of the torch; a sampling cone for passing therethrough the sample ionized by the plasma; and a mass spectrometer for carrying out mass spectrometry of ions of the ionized sample passed through the sampling cone.

Incidentally, it is clearly possible to provide a spectrometer for analyzing light of the plasma in place of the sampling cone 1 and the mass spectrometer, in order to apply the invention to an inductively coupled plasma spectrochemical analyzer.

The present invention is structured to provide a branch pipe at an innermost pipe of a torch in an organic solvent sample introducing apparatus for an inductively coupled plasma spectrometer so that an oxygen gas controllable in flow rate can be introduced through the branch pipe, thereby giving the following effects.

(1) The oxygen gas can be prevented to a minimum possible extent from intruding into the chamber.

(2) Since the oxygen concentration within the chamber can be decreased, the oxygen gas can be supplied in an amount required to suppress plugging of the torch tip or the sampling cone and decrease in sensitivity due to carbon C without fear of bursting the chamber.

(3) Carbon C is turned into carbon dioxide $CO_2$ or carbon monoxide CO to a sufficient extent so that plugging is avoided and high sensitive measurement becomes possible.

What is claimed is:

1. An inductively coupled plasma mass spectrometric analyzer, comprising:

a nebulizer for atomizing a liquid sample;

a chamber for separating an atomized sample;

a torch comprising pipes separated by fluid therein for introducing and transporting therethrough the separated sample and a plasma gas, respectively, said torch having an induction coil arranged around a tip thereof so that a plasma is formed by a radio-frequency electric power supplied to said induction coil;

a branch pipe connected to said pipe of said torch to which said separated sample is introduced and transported, said branch pipe being for introducing therethrough an oxygen gas controllable in flow rate to said pipe of said torch;

a sampling cone for passing therethrough the sample ionized by said plasma; and a mass spectrometer for carrying out mass spectrometry of ions of the ionized sample passed through said sampling cone.

2. An inductively coupled plasma spectrochemical analyzer, comprising:

a nebulizer for atomizing a liquid sample;

a chamber for separating an atomized sample;

a torch comprising pipes separated by fluid therein for introducing and transporting therethrough the separated sample and a plasma gas, respectively, said torch having an induction coil arranged around a tip thereof so that a plasma is formed by a radio-frequency electric power supplied to said induction coil;

a branch pipe connected to said pipe of said torch to which said separated sample is introduced and transported, said branch pipe being for introducing therethrough an oxygen gas controllable in flow rate to said pipe of said torch; and a spectrochemical analyzer for carrying out spectrometry of light of said plasma.

* * * * *